US007987638B1

(12) United States Patent
Fang

(10) Patent No.: US 7,987,638 B1
(45) Date of Patent: Aug. 2, 2011

(54) POST-TENSIONING RETROFIT ASSEMBLIES FOR REINFORCING STRUCTURAL MEMBERS

(76) Inventor: Lee Fang, Amherst, NY (US)

( * ) Notice: Subject to any disclaimer, the term of this patent is extended or adjusted under 35 U.S.C. 154(b) by 625 days.

(21) Appl. No.: 11/906,054

(22) Filed: Sep. 28, 2007

Related U.S. Application Data

(60) Provisional application No. 60/899,975, filed on Feb. 7, 2007.

(51) Int. Cl.
*E04B 1/98* (2006.01)

(52) U.S. Cl. ..... 52/167.1; 52/223.3; 52/223.4

(58) Field of Classification Search ..... 52/167.1, 52/223.14, 223.4, 248, 291, 514, 835
See application file for complete search history.

(56) References Cited

U.S. PATENT DOCUMENTS

| | | | | |
|---|---|---|---|---|
| 1,474,243 | A * | 11/1923 | Dennis | 220/610 |
| 4,071,996 | A | 2/1978 | Muto et al. | |
| 4,905,436 | A | 3/1990 | Matsuo et al. | |
| 5,174,080 | A | 12/1992 | Yoshimura et al. | |
| 5,218,810 | A | 6/1993 | Isley, Jr. | |
| 5,335,470 | A * | 8/1994 | Alvarez | 52/699 |
| 5,370,483 | A * | 12/1994 | Hood et al. | 411/10 |
| 5,561,956 | A | 10/1996 | Englekirk et al. | |
| 5,607,527 | A | 3/1997 | Isley, Jr. | |
| 5,782,043 | A | 7/1998 | Duncan et al. | |
| 5,799,451 | A | 9/1998 | Pilakoutas | |
| 5,960,597 | A | 10/1999 | Schwager | |
| 5,970,668 | A | 10/1999 | Arthurs et al. | |
| 6,135,687 | A | 10/2000 | Leek et al. | |
| 6,167,672 | B1 | 1/2001 | Okitomo | |
| 6,219,991 | B1 | 4/2001 | Salek-Nejad | |
| 6,247,279 | B1 | 6/2001 | Murat et al. | |
| 6,276,097 | B1 | 8/2001 | Whitley | |
| 6,718,723 | B1 | 4/2004 | Al-Tuhami | |
| 2004/0055234 | A1 | 3/2004 | Mutsuyoshi | |

FOREIGN PATENT DOCUMENTS

| | | |
|---|---|---|
| CH | 640371 | 12/1983 |
| JP | 2279874 | 11/1990 |
| JP | 2000213280 | 8/2000 |
| WO | WO9949155 | 9/1999 |
| WO | WO0036222 | 6/2000 |
| WO | WO2004079207 | 9/2004 |

OTHER PUBLICATIONS

Murat Saatcioglu and Cem Yalcin, "External Pre-stressing Concrete Columns for Improved Seismic Shear Resistance," Journal of Structural Engineering, pp. 1057-1070 (Aug. 2003).

* cited by examiner

*Primary Examiner* — Jeanette E Chapman
*Assistant Examiner* — Daniel Kenny
(74) *Attorney, Agent, or Firm* — Simpson & Simpson, PLLC

(57) ABSTRACT

A retrofit assembly for reinforcing a structural member including a plurality of retrofit segments including a first retrofit segment and a last retrofit segment, wherein the first retrofit segment connects to the last segment, and wherein each of the retrofit segments comprises a connecting rod, a brace, and a threaded nut, wherein the connecting rods each include a first end and a second end, wherein the first ends are each fixedly secured to one of the braces, and the second ends are each operatively threaded to engage with one of the nuts, and wherein the braces each include a hole operatively sized to receive the second end of one of the connecting rods.

9 Claims, 8 Drawing Sheets

POST-TENSIONING RETROFIT ASSEMBLIES FOR REINFORCING STRUCTURAL MEMBERS

CROSS REFERENCE TO RELATED APPLICATIONS

This patent application claims the benefit under 35 U.S.C. §119(e) of U.S. Provisional Application No. 60/899,975, filed Feb. 7, 2007, which application is incorporated herein by reference.

FIELD OF THE INVENTION

The present invention relates generally to reinforced structures, more specifically to retrofitted reinforced structures, and even more specifically to retrofit assemblies which provide pre-stresses to reinforce structures.

BACKGROUND OF THE INVENTION

It is well known in the art that bridges, buildings, overpasses, and other structures are commonly supported by large columns and beams. Regularly these large columns, beams, or other structural members, are constructed from concrete. As concrete members age, however, the structural properties of the members deteriorate. It is extremely expensive, and sometimes impossible, to replace large support members in a structure such as a bridge, without tearing down the entire structure and rebuilding. For these reasons, retrofits have been developed to strengthen aging structural members. The retrofits deliver stresses in the cross-sectional directions of the structural members. Pre-stresses have been found to improve such properties as the shear strength, lateral confinement, and ductility of the structural members.

U.S. Pat. No. 6,247,279 (Murat et al.) discloses one style of retrofit for concrete columns. Murat et al. teach a retrofit system which includes strands which are wrapped around the concrete column, tensioned, and held in place with anchors. Since strands generally can not be threaded, a wedge and anchor system is used to hold the strands in tension around the concrete columns. Since the strands are highly tensioned, they require special equipment, such as a hydraulic jack system, to be installed. Additionally, the hydraulic jack system is required to replace or remove the retrofit, in the event that maintenance must be preformed on either the retrofit or the column. Also, the strands are not flexible enough to bend flush around rectangular columns or other structural members with sharp corners. As a result, this invention requires a plurality of separate corner pieces and risers to effectively be installed on a rectangular column. These additional pieces add to the complexity of installing and uninstalling this retrofit invention in the field, since all of these pieces must be aligned, then held in place while each strand is being installed.

U.S. Pat. No. 6,718,723 (Al-Tuhami) discloses another style of retrofit for strengthening concrete structural elements. The retrofit taught by Al-Tuhami has two separate assemblies which must be custom made at the job site where the retrofit is being installed. First, corner pieces are installed on each of the four corners of a rectangular column. Then a pressure casing is installed over the corner pieces. The pressure casing includes four corner pieces which extend down the desired length of the column at each corner. Alternating pairs of adjacent corner pieces of the casing are bolted together with threaded rods and nuts down the length of the structural member. After the original corner pieces have been tensioned in place by the pressure casing, splices are cut to connect the corner pieces. The splices are welded to adjacent pairs of the original corner members. After a sufficient number of splices have been welded in place, the pressure casing is removed. However, when the pressure casing is removed the splices will undergo a period of elongation. This elongation will loosen the fit of the splices on the concrete element, and therefore lower the pre-stresses supplied by the splices. This invention uses excess material, specifically the pressure casing, which is only attached temporarily to each column. Additionally, there is a substantial amount of fieldwork required, specifically cutting and welding, which is generally more expensive and time consuming than equivalent work done in a machine shop.

Thus, there is a long felt need for a retrofit assembly which pre-stresses structural members and can be quickly and easily installed without the use of special equipment or extensive fieldwork.

BRIEF SUMMARY OF THE INVENTION

The present invention broadly comprises a retrofit assembly for reinforcing a structural member including a plurality of retrofit segments including a first retrofit segment and a last retrofit segment, wherein the first retrofit segment connects to the last segment, and wherein each of the retrofit segments comprises a connecting rod, a brace, and a threaded nut, wherein the connecting rods each include a first end and a second end, wherein the first ends are each fixedly secured to one of the braces, and the second ends are each operatively threaded to engage with one of the nuts, and wherein the braces each include a hole operatively sized to receive the second end of one of the connecting rods.

In one embodiment the retrofit assembly is generally rectangular in shape, and in another embodiment the retrofit assembly is circular. In a further embodiment the retrofit assembly includes force distributors located between the retrofit segments and the structural member. In a further embodiment the retrofit segments each include a direct tension indicator.

It is a general object of the present invention to provide a retrofit assembly to strengthen a structural member.

It is another object of the present invention to provide a retrofit assembly which can be entirely or almost entirely pre-fabricated in a workshop.

It is yet a further object of the present invention to provide a retrofit assembly which does not require special equipment to be installed or removed.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects. Also, the adjectives, "top", "bottom", "right", "left", "front", "back", and their derivatives, in the description herebelow, refer to the perspective of one facing the invention as shown in the figure under discussion.

Furthermore, it should be understood that this invention is not limited to the particular methodology, materials and modifications described and as such may, of course, vary. It should also be understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described. Therefore it should be appreciated that the post-tensioning force caused by the tightened rods is responsible for the pre-stresses experienced by the structural members.

Adverting now to the drawings, FIG. 1 is a front view of a representative framework, having support columns and beams, which are equipped with retrofit assemblies. Columns 14*a*, 14*b*, 14*c*, and 14*d* in combination with beams 12*a*, 12*b*, 12*c*, and 12*d* make up framework 10, and are all representative structural members. In a preferred embodiment, the columns and beams are made from concrete. Framework 10 is a representative structure illustrated to help demonstrate possible scenarios in which retrofit assembly 20 is installed and used.

Retrofit assembly 10 is typically most effective when installed at locations proximate the ends of the structural member or junctions between members. Therefore, one place to install one or more retrofit assemblies could be the bottom of a column, as shown on columns 14*b* and 14*c*. Retrofit assembly 20 may also be secured at the junction of a beam and a column, as represented at the junctions of columns 14*b* with beams 12*c* and 12*d*, column 14*c* with beams 12*c* and 12*d*, and column 14*d* with beams 12*c* and 12*d*. Retrofit assembly 20 may also be installed at intervals down the long length of a beam or column, as represented between columns 14*c* and 14*d* on beams 12*c* and 12*d*.

Figure 1A:
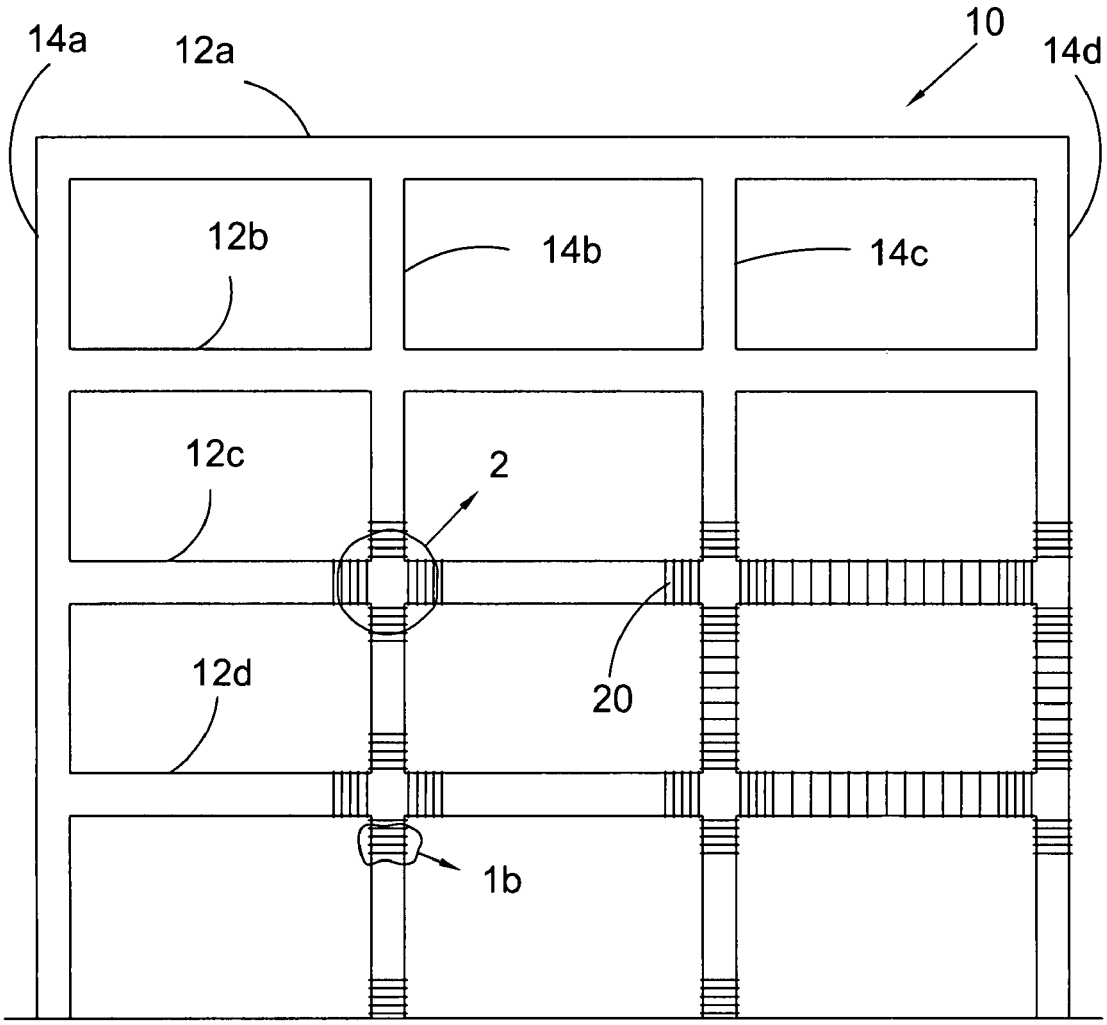
FIG. 1*a* is a front view of a representative framework, having support columns and beams, which are equipped with retrofit assemblies.
Figure 1B:
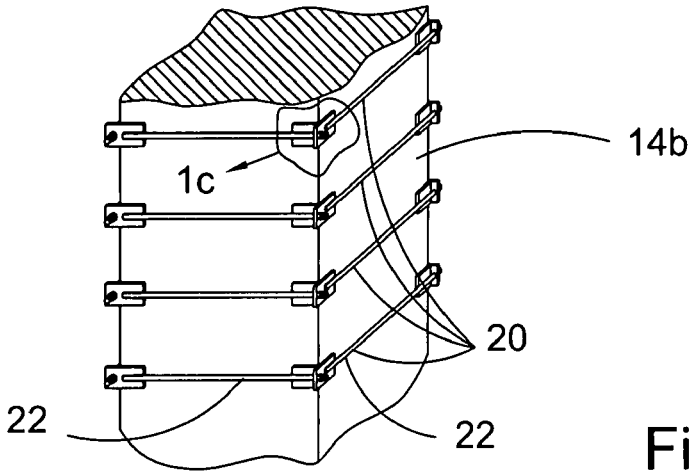
FIG. 1*b* is an enlarged perspective view of the area encircled in FIG. 1*a* of a portion of a column equipped with four retrofit assemblies.

FIG. 1*b* illustrates a perspective view of the area on column 14*b* circled in FIG. 1*a*. Column 14*b* is illustrated as having a substantially rectangular cross-section. In this embodiment, each retrofit assembly is illustrated as being comprised of retrofit segments 22. In this embodiment, there is one retrofit segment for each face of the structural member onto which the assembly is being installed. Although two of the segments are blocked from view behind the column, in this embodiment there are a total of four retrofit segments 22 which attach around the cross-section of the column.

Figure 1C:
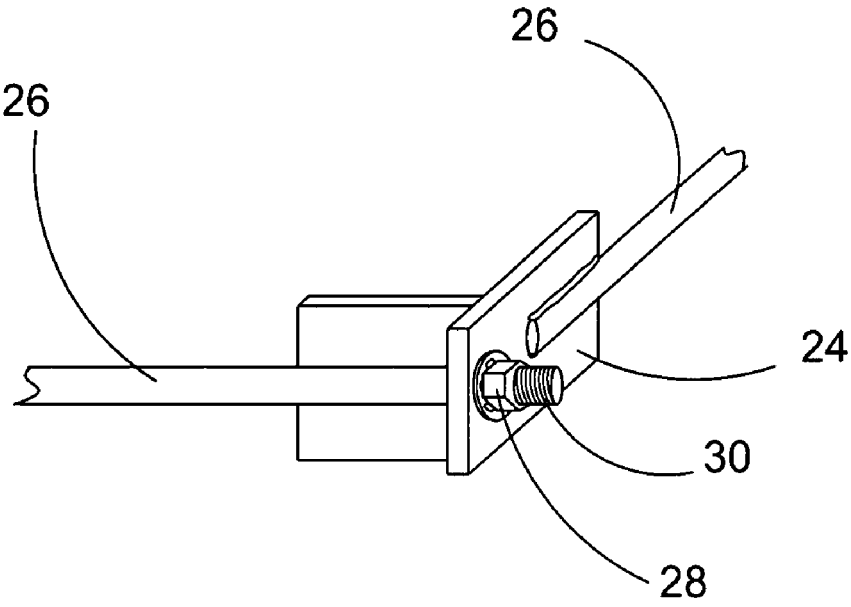
FIG. 1*c* is a perspective view of two retrofit segments connected.

An enlarged view of the area circled in FIG. 1*b* is shown in FIG. 1*c*. A first end of connecting rod 26 is fixedly secured to brace 24. Connecting rod 26 is part of a first retrofit assembly, which is on the left, and it is connected through hole 32 in brace 24, which is part of the second retrofit assembly on the right. A second end of connecting rod 26 is threaded end 30, which is tightened to brace 24 with nut 28. Each of the retrofit segments connect in substantially this same manner in a sequential order. By sequential order, we mean that a first retrofit segment connects to a second retrofit segment, the second retrofit segment connects to a third retrofit segment, and continuing so that each retrofit segment connects to a new retrofit segment, until a last retrofit segment in the sequence connects back to the first retrofit segment. For example, in the embodiment shown the segments connect sequentially so that a first segment connects to a second segment, which connects to a third segment, which in turn to connects to a fourth segment, and the fourth segment connects back to the first segment. The members connect in this way to create a closed assembly, which is retrofit assembly 20. It should be appreciated that in an alternate embodiment, only two retrofit segments are used, and they connect to each other at both ends.

Figure 1D:
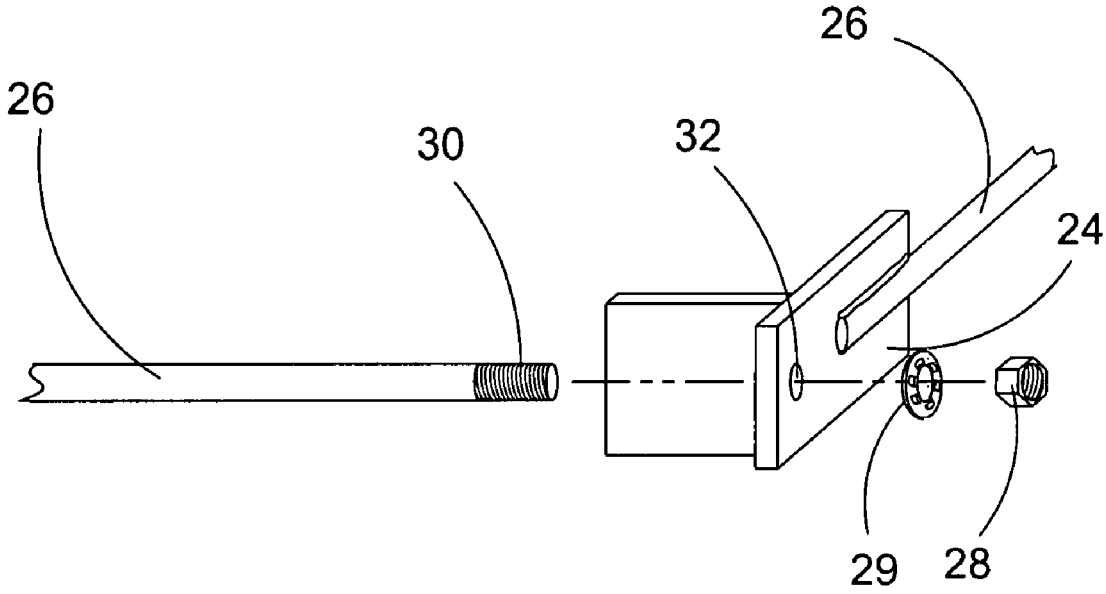
FIG. 1*d* is an exploded perspective view of the two retrofit segments seen in FIG. 1*c;*

The components of the retrofit assembly in FIG. 1*c* are displayed exploded in FIG. 1*d*. It should be clear to one of ordinary skill in the art that threaded end 30 of connecting rod 26 goes through hole 32 and is tightened in place by nut 28. Advantageously, nut 28 is any standardized nut, such as from the metric or English measurement systems, which are very common in the art. Therefore, nut 28 can be tightened by a readily available, correspondingly sized standard wrench, which is also well known and used in the art.

Direct tension indicator 29 is also included in a preferred embodiment. The direct tension indicator can be any direct tension indicator known in the art. Commonly, direct tension indicators are washers which have protrusions on one face that are designed to indicate when they have been subjected to a specified force, but other styles of direct tension indicators may be used. The direct tension indicators are installed under bolt heads or nuts and the protrusions completely flatten when the direct tension indicator experiences the specified force. Therefore, one can control the amount of tension in bolts or threaded rods by using direct tension indicators. The post-tensioning force from the rods is exerted through substantially all cross-sectional directions of the structural member.

It should be apparent to one with ordinary skill in the art that the present invention does not require any specialized equipment to install or uninstall. A standard wrench is the only tool needed to install the retrofit assemblies. Furthermore, no custom work needs to be done in the field. By in the field we mean at the location or job site of the structural member which is being retrofitted. Therefore, all pieces can be pre-fabricated in a machine shop and no welding or cutting needs to be done in the field. Also, since the retrofit segments can be pre-fabricated, it would also be possible to standardize the retrofit assemblies.

Figure 2:
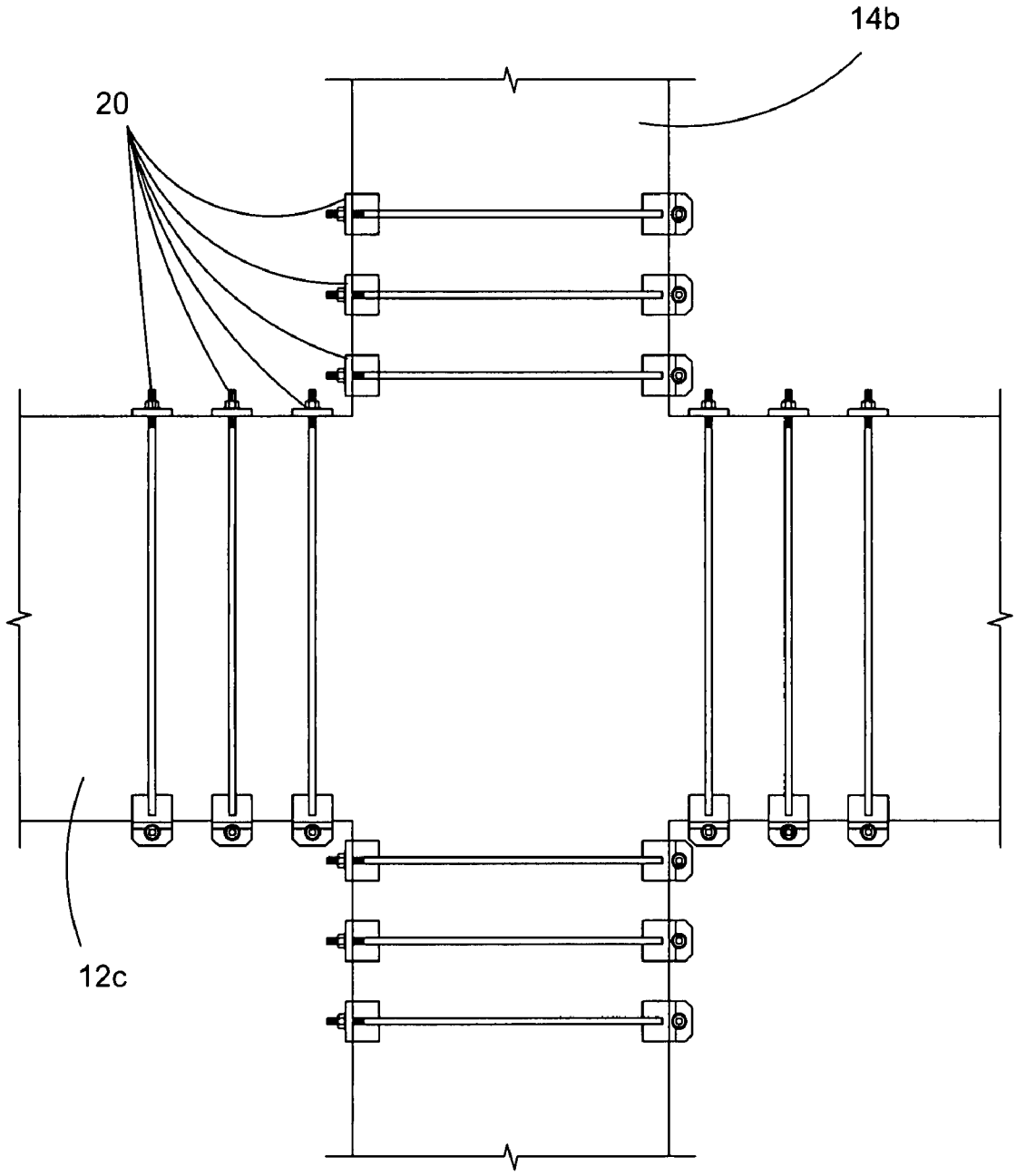
FIG. 2 is an enlarged view of the area encircled in FIG. 1 illustrating an intersection of a column and a beam with twelve retrofit assemblies installed.

FIG. 2 is a front view of the junction of column 14*b* with beam 12*c*, which was circled in FIG. 1, showing a total of twelve retrofit assemblies. In a preferred embodiment several retrofit assemblies are placed proximate each other to provide additional support down a portion of the length of a beam or column. It should be appreciated, however, that any number, including just a single retrofit assembly can be installed, as needed, in different embodiments of the invention.

Figure 3:
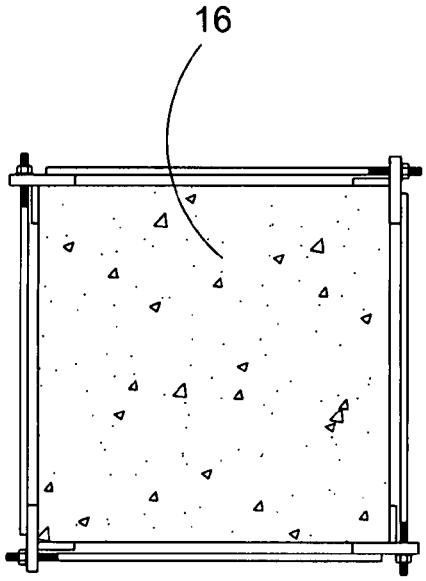
FIG. 3 is a cross-section of a rectangular structural member equipped with a retrofit assembly.
Figure 4:
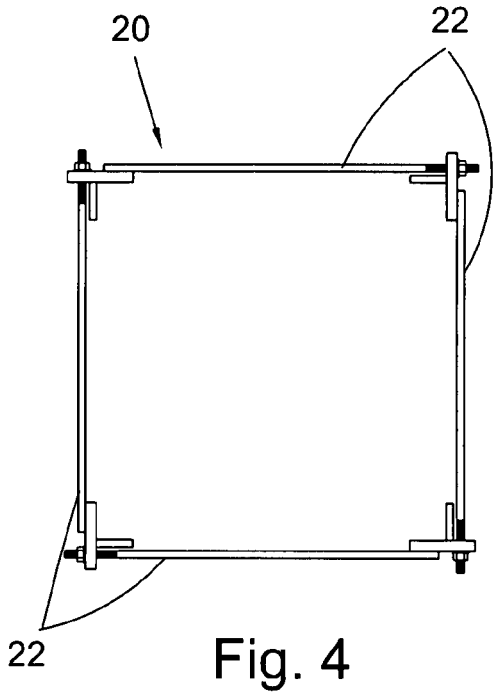
FIG. 4 is a top view of a first embodiment retrofit assembly.

A first embodiment of the invention is illustrated in FIGS. 3-7. FIG. 3 is a top view of rectangular structural member 16 equipped with retrofit assembly 20. Rectangular structural member 16 can be a column, beam, or any other structural member with a rectangular cross-section. In this embodiment, retrofit assembly 20 is comprised of four retrofit segments 22. Just the retrofit assembly is shown in FIG. 4, without the structural member.

Figure 5:
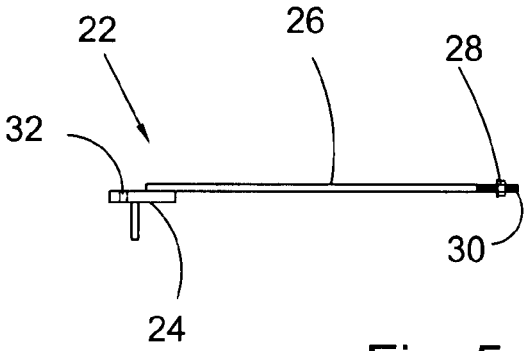
FIG. 5 is a partial front view of a retrofit segment from the retrofit assembly shown in FIG. 4.

Each retrofit segment is comprised essentially of brace 24, connecting rod 26, and nut 28, as shown in FIG. 5. Connecting rod 26 has threaded end 30 onto which nut 28 is removably secured. Brace 24 has a substantially T-shaped profile, as shown. In a preferred embodiment the brace gets this T-shape by welding two substantially perpendicular plates together. However, it should be recognized that brace 24 could easily be made out of a single piece. A corner of the T-shape of the brace allows the brace to lie flush against a corner of the structural member. This enables the brace to more effectively transfer pre-stresses from the tightened threaded rods into the structural member. Brace 24 also includes hole 32 in the part of the brace farthest from the structural member when the retrofit assembly is installed. The hole is operatively sized so that connecting rod 26 can engage with and pass through the hole.

Figure 6:
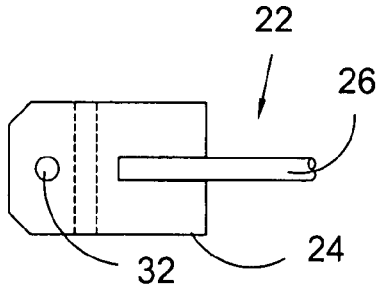
FIG. 6 is a top view of a retrofit segment from the retrofit assembly shown in FIG. 4.

FIG. 6 shows an enlarged view of the end of retrofit segment 22 which includes brace 24. Hole 32 is once again illustrated located in brace 24. Connecting rod 26 is shown affixed to the top side of the brace. In preferred embodiments connecting rod 26 and brace 24 are made of metal, and they are welded together. However, it should be appreciated that the particular materials or methods of affixing or securing components together are not germane to the invention, and could be any suitable materials or methods known in the art.

Figure 7:
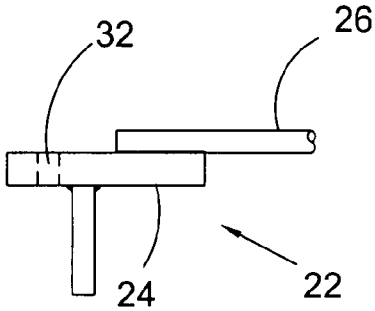
FIG. 7 is a is an enlarged partial view of the retrofit segment seen in FIG. 5, illustrating a brace on one end of the retrofit segment.
Figure 8:
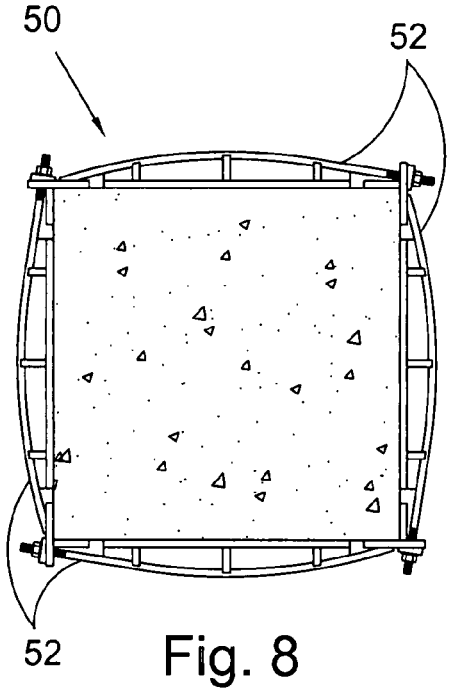
FIG. 8 is a top view of a rectangular structural member equipped with a second embodiment of retrofit assembly which includes a force distributor.
Figure 9:
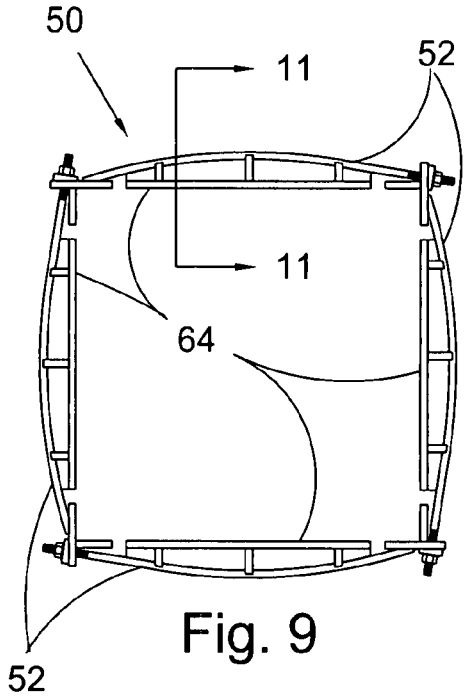
FIG. 9 is a top view of a second embodiment of a retrofit assembly.
Figure 10A:
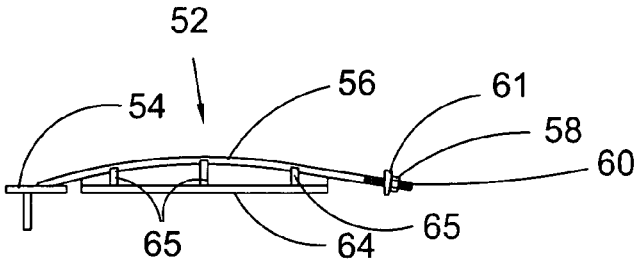
FIG. 10*a* is a front view of a retrofit segment for the retrofit assembly shown in FIG. 9.
Figure 10B:
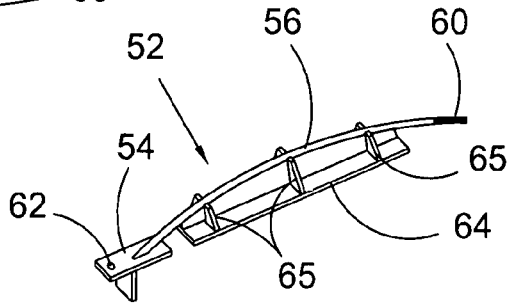
FIG. 10*b* is a perspective view of the retrofit segment seen in FIG. 10*a;*

FIG. 7 is an enlarged view of the front of brace 24. The brace is shown affixed to connecting rod 26. Hole 32 can once again be seen through the brace.

A second embodiment of the present invention, generally referred to as retrofit assembly 50, is illustrated in FIGS. 8-14. This embodiment is also installed on rectangular structural members. However, this embodiment further includes force distributors 64, which are located on an inner portion of the connecting rods. By inner portion, we mean the portion closest to the structural member, which is on the inside of a closed retrofit assembly. Retrofit assembly 50 is comprised of four force distributors and four retrofit segments 52, which are connected to each other in a substantially similar manner as the segments in assembly 20.

In the second embodiment, retrofit assembly 50 includes force distributors 64. Shown in FIGS. 10*a* and 10*b*, retrofit segment 52 includes brace 54, curved connecting rod 56, and nut 58. Connecting rod 56 is curved so that when the connecting rod is tightened, a component of the exerted force will act downward, in the direction of the force distributor. Force distributor 64 includes ribs 65 which increase the stability of the force distributor.

Figure 11:
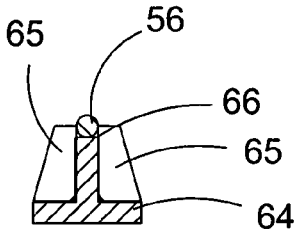
FIG. 11 is a cross-sectional view taken generally along line 11-11 in FIG. 9 showing a connecting rod resting in a channel at the top of a force distributor.

In a preferred embodiment, as shown in FIG. 11, the cross section of force distributor 64 is generally T-shaped. In this embodiment the force distributor is made from two bars welded together, however, it could be made from a single piece in an alternate embodiment. In this embodiment, ribs 65 are located at intervals down the length of the force distributor. The ribs add stability to the force distributor, and also help define channel 66 located at the top of the distributor. Connecting rod 56 rests in channel 66, and the ribs help ensure that the connecting rod does not slip out.

Like the retrofit segments, in a preferred embodiment the force distributors are made of metal. In this embodiment, the ribs are affixed to the force distributor by welding. It should be appreciated that various materials and methods of construction are known in the art, and could be substituted for the preferred embodiment described, without departing from the scope of the invention.

Any downward forces exerted by the connecting rods are transferred to the force distributors, which in turn are transferred into the structural member. Without the force distributors the forces exerted by the braces would primarily act at the corners, and therefore there would be little or no confining forces acting on the middle portion of the faces of the structural columns.

Figure 12:
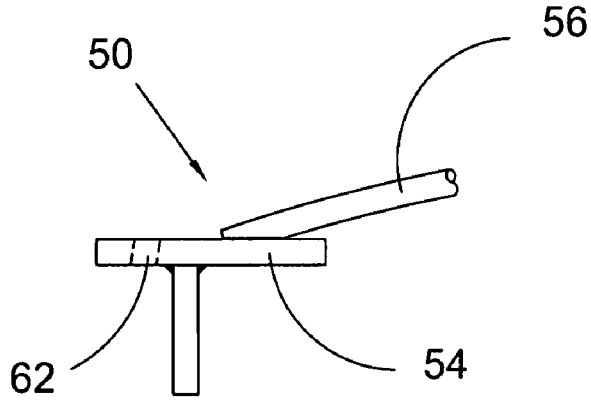
FIG. 12 is a partial view of the retrofit segment shown if FIG. 10*a*, illustrating a brace on one end of the retrofit segment.

Brace 54 is substantially similar to brace 24, as can be seen by comparing FIG. 12 with the previous figures which illustrated the first embodiment. However, brace 54 includes hole 62 which in a preferred embodiment is orientated at a non-perpendicular angle. Hole 62 is made at an angle to account for the curvature of connecting rod 56, which must pass through the hole.

Figure 13:
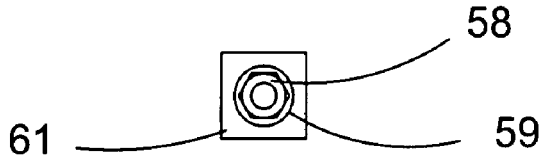
FIG. 13 is a front view of a nut, a direct tension indicator, and a spacer for the retrofit assembly shown in FIG. 9.

Nut 58 is substantially the same as nut 28, as can be seen by examining FIG. 13 and the previous Figures which illustrated the first embodiment. Likewise, direct tension indicator 59 is substantially the same as direct tension indicator 29.

Figure 14:
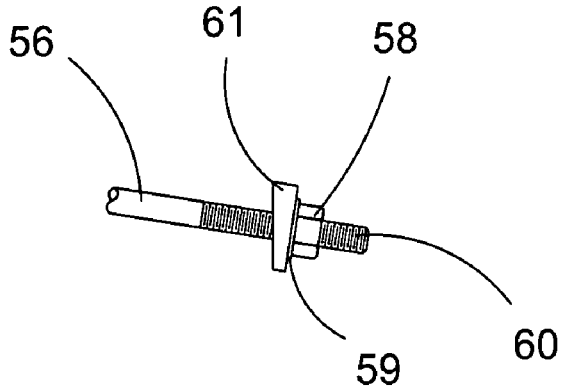
FIG. 14 is a partial front view of the nut seen in FIG. 13 threaded onto the end of a connecting rod of the retrofit segment seen in FIG. 10*a;*
Figure 15:
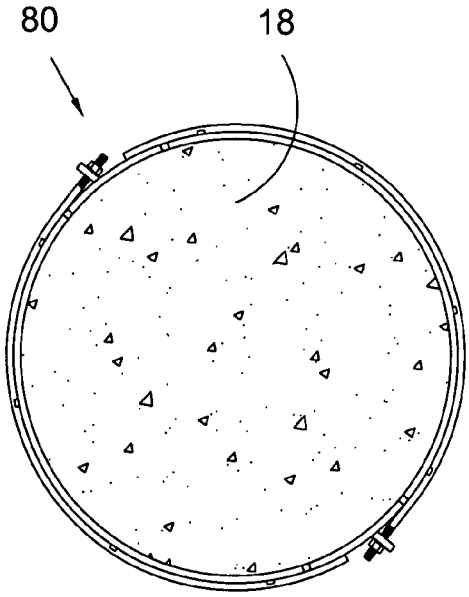
FIG. 15 is a top view of a circular structural member equipped with a third embodiment of a retrofit assembly.

FIG. 14 shows nut 58, direct tension indicator 59, and spacer 61 on threaded end 60 of connecting rod 56. The left side of the spacer, as shown, is cut at an angle. Spacer 61 has an angled edge to account for the curvature of connecting rod 56. Without the spacer, nut 58 could not be properly tightened on brace 54, and direction tension indicator 59 would not operate correctly, since the face of the nut and tension indicator would not be parallel to the face of brace. In some embodiments, spacer 61 is a tapped washer.

A third embodiment of the present invention, shown in FIGS. 15-19, is generally referred to as retrofit assembly 80. This assembly is installed on members with circular cross-sections, such as circular structural member 18. Circular structural member 18 is a representative structural member with a circular cross-section, which could be a beam, column, or any other structural member.

Figure 16:
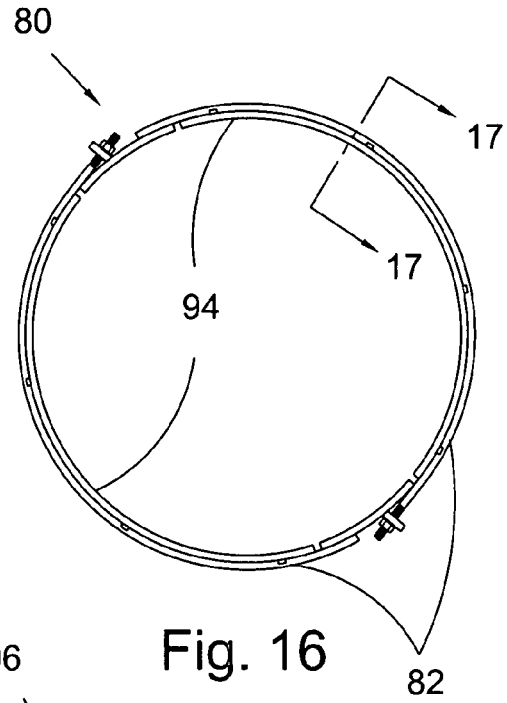
FIG. 16 is the retrofit assembly seen in FIG. 15.

FIG. 16 shows retrofit assembly 80 without a structural member. In this embodiment, assembly 80 has only two segments 82. Each retrofit segment 82 has an accompanying force distributor 94. Retrofit segments 82 secure together similar to the first two embodiments. It should be appreciated that any number of retrofit segments may be used depending on the size and geometry of the structural member.

Figure 17:
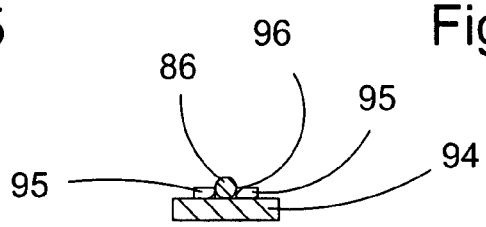
FIG. 17 is a cross-section of the retrofit assembly and force distributor seen in FIG. 16, illustrating how a connecting rod of the retrofit assembly fits in a channel on the force distributor.

As was seen with force distributor 64, force distributor 94 has ribs 95 which help define channel 96 for the connecting rod to rest in, as is shown in FIG. 17. The connecting rod transfers force into the force distributor, which in turn, transfers it into the structural member.

Figure 18:
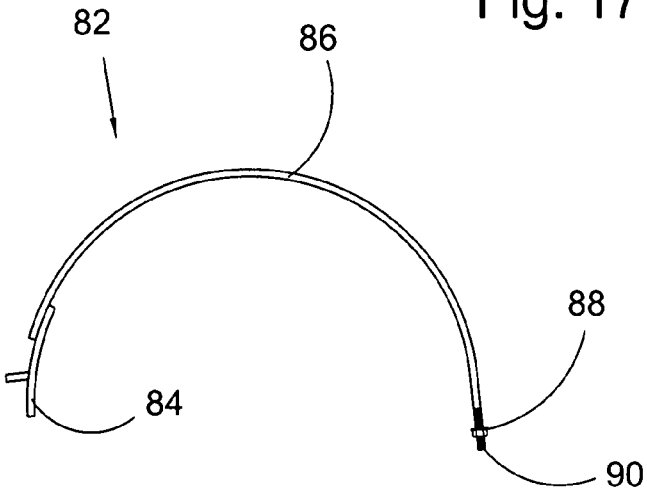
FIG. 18 is a retrofit segment for the retrofit assembly seen in FIG. 16.

FIG. 18 shows retrofit segment 82, which is operatively shaped to be installed on a circular structural member, such as structural member 18. Segment 82 includes brace 84, connecting rod 86, and nut 88, which is on threaded end 90 of the connecting rod.

Figure 19:
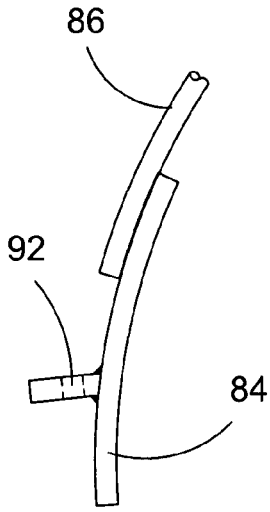
FIG. 19 is a partial front view of the retrofit segment shown in FIG. 18, illustrating a brace on one end of the segment.
Figure 20:
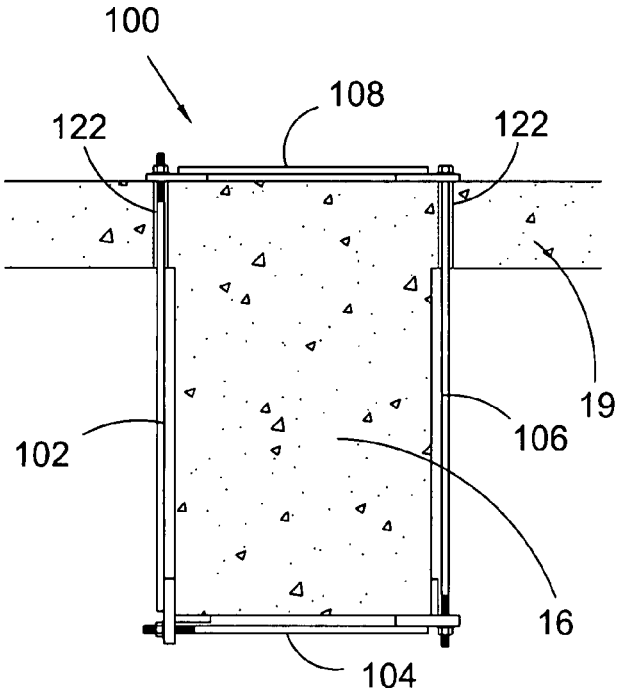
FIG. 20 is a fourth embodiment of a retrofit assembly which is installed through a floor slab and around a rectangular structural member.

Brace 84 is generally T-shaped, as were braces 24 and 54, but it is curved so that it can lie flush against circular structural member 18. FIG. 19 shows how brace 84 is curved, and that it includes hole 92 which is operatively arranged to receive a connecting rod.

A fourth embodiment of the present invention, referred to as retrofit assembly 100, is shown in FIGS. 20-24. This embodiment is for structural members which are located directly below a floor slab. Whereas the first three embodiments, retrofit assemblies 20, 50, and 80 were each comprised of substantially identical segments, this is not the case for retrofit assembly 100. First segment 102 and second segment 104 are similar to retrofit segment 22, and each include a brace, a connecting rod, and a nut. However, in a preferred embodiment, as shown, first segment 102 must be long enough to go through floor slab 19 and down a side of rectangular structural member 16, so the connecting rod of first segment 102 is shown longer than the connecting rod of second segment 104. In a preferred embodiment each connecting rod includes threaded end 116 engaged with nut 114.

Figure 22:
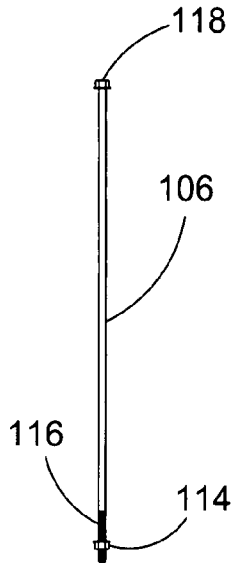
FIG. 22 is a rod segment for a fourth embodiment of a retrofit assembly.
Figure 21:
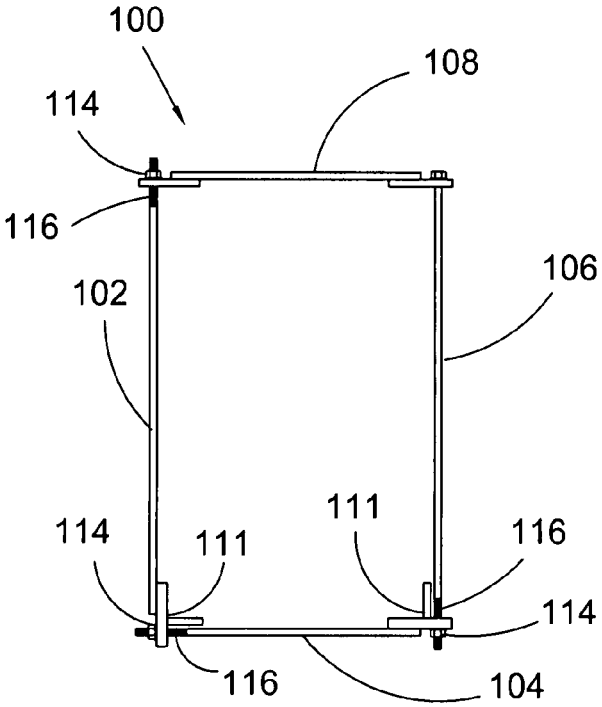
FIG. 21 is the retrofit assembly shown in FIG. 20.

FIG. 22 shows rod segment 106, which includes a straight rod with threaded end 116 engaged with nut 114. The rod segment also includes head 118, which is hexagonal in the shown embodiment, but it should be appreciated that it could be any shape. Head 118 is larger in diameter than through-hole 122 in floor slab 19. Therefore, segment 106 can be properly tightened because it is held in place by head 118.

Figure 23:
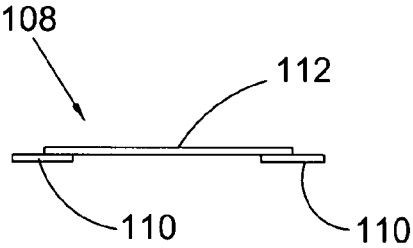
FIG. 23 is a front view of a floor segment of the retrofit assembly shown in FIG. 20; and, FIG. 24 is a partial top view of the floor segment shown in FIG. 23, illustrating a floor brace on one end of the floor segment.
Figure 24:
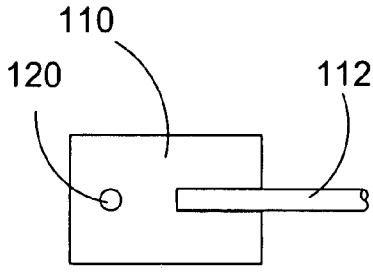

FIGS. 23-24 illustrate floor segment 108 which has non-threaded connecting rod 112 with floor braces 110 connected at each side. The floor braces are flat and therefore do not have a T-shaped profile, like braces 111 on retrofit segments 102 and 104. Each brace 110 has hole 120 in it to allow the corresponding connecting rods through. Floor segment 108 is shaped in this way to minimize the amount of floor slab 19 that needs to be removed to make room for the retrofit. It should be appreciated that in other embodiments segments 106 and 108 could be replaced with segments substantially identical to segments 102 and 104, respectively, but this might require additional time and effort to remove enough material to make ample space for the braces.

It should be appreciated that the material of the connecting rods, braces, nuts, and force distributors in all preferred embodiments is a metal, such as steel. Also, in further embodiments the retrofit assemblies are made with resistant coatings or are anodized. However, it should be appreciated metal is only the preferred material, and other materials could be similarly used in other embodiments.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. A retrofit assembly for reinforcing a rectangular structural member comprising:

a plurality of retrofit segments including a first retrofit segment, a second retrofit segment, a third retrofit segment, and a last retrofit segment, wherein each of said retrofit segments comprises a connecting rod, a brace, and a threaded nut;

wherein said connecting rods each include a first end and a second end, wherein said first ends are each fixedly secured to one of said braces, and said second ends are each operatively threaded to engage with one of said nuts;

wherein each of said braces is arranged having a substantially T-shaped cross-section forming a substantially perpendicular corner for complementarily engaging with a corresponding corner of said structural member;

wherein said braces each include a portion of said T-shaped cross-section which does not engage with said structural member, said portions each including a hole operatively sized to receive said second end of one of said connecting rods;

wherein each retrofit segment connects to a subsequent retrofit segment in said plurality by inserting said second end of said connecting rod of each retrofit segment into said hole in said brace of said subsequent retrofit segment and tightening said threaded nut on said second end of said connecting rod of each retrofit segment, and in this way said first retrofit segment connects to said second retrofit segment, said second retrofit segment connects to said third retrofit segment, said third retrofit segment connects to said last retrofit segment, and said last retrofit segment connects to said first retrofit segment for forming a closed rectangular assembly about said structural member; and, wherein each retrofit segment in said plurality is individually tensionable by tightening or loosening said threaded nut corresponding to each retrofit segment.

2. The retrofit assembly recited in claim 1 wherein said retrofit segments in said plurality are connected sequentially so that said first retrofit segment connects to a second retrofit segment, continuing in a sequential order until said last retrofit segment connects to said first retrofit segment.

3. The retrofit assembly recited in claim 1 wherein said retrofit assembly is arranged in a generally rectangular shape.

4. The retrofit assembly recited in claim 1 wherein said retrofit assembly is arranged in a generally circular shape.

5. The retrofit assembly recited in claim 1 further comprising a plurality of force distributors located proximate an inner portion of said connecting rods.

6. The retrofit assembly recited in claim 5 wherein each force distributor in said plurality of force distributors includes a channel for holding said connecting rods.

7. The retrofit assembly recited in claim 6 wherein said force distributors further comprise ribs which are operatively arranged to further define said channel.

8. The retrofit assembly recited in claim 1 wherein said retrofit segments each further comprise a direct tension indicator engaged with said connecting rods.

9. The retrofit assembly recited in claim 1 wherein said connecting rods are curved, and said retrofit segments further include a plurality of angled spacers located between said nuts and said braces for allowing said nuts to tighten flush against said braces.

* * * * *